US007004598B2

(12) United States Patent
Wong

(10) Patent No.: US 7,004,598 B2
(45) Date of Patent: Feb. 28, 2006

(54) FLASHING LIGHT SYSTEM WITH POWER SELECTION

(75) Inventor: Wai Kai Wong, Hong Kong (CN)

(73) Assignee: Cheerine Development (Hong Kong) Ltd., Hong Kong (CN)

( * ) Notice: Subject to any disclaimer, the term of this patent is extended or adjusted under 35 U.S.C. 154(b) by 283 days.

(21) Appl. No.: 10/370,209

(22) Filed: Feb. 18, 2003

(65) Prior Publication Data

US 2004/0160196 A1 Aug. 19, 2004

(51) Int. Cl.
*H05B 37/02* (2006.01)

(52) U.S. Cl. ..... 362/103; 362/800; 315/200 A; 315/360

(58) Field of Classification Search ..... 315/200 A, 315/241 S, 241 P, 360; 362/84, 103, 800
See application file for complete search history.

(56) References Cited

U.S. PATENT DOCUMENTS

| | | | |
|---|---|---|---|
| 1,597,823 | A | 8/1926 | Randolph |
| 1,933,243 | A | 10/1933 | De Merolis et al. |
| 2,572,760 | A | 10/1951 | Rikelman |
| 2,634,407 | A | 4/1953 | Johnson |
| 2,671,209 | A | 3/1954 | Habib |
| 2,671,847 | A | 3/1954 | Lerch |
| 2,816,284 | A | 12/1957 | Campanell |
| 2,849,819 | A | 9/1958 | Murphy et al. |
| 2,931,893 | A | 4/1960 | Gonzalez Arias et al. |
| 2,959,892 | A | 11/1960 | Johnson |
| 2,976,622 | A | 3/1961 | Shearouse |
| 3,008,038 | A | 11/1961 | Dickens et al. |
| 3,053,949 | A | 9/1962 | Johnson |
| 3,070,907 | A | 1/1963 | Rocco |
| 3,564,232 | A | 2/1971 | Ellerbe et al. |
| 3,731,022 | A | 5/1973 | Loftus |
| 3,800,133 | A | 3/1974 | Duval |
| 3,893,247 | A | 7/1975 | Dana, III |
| 3,946,505 | A | 3/1976 | Dana, III |
| 3,968,641 | A | 7/1976 | Moyer |
| 4,009,387 | A | 2/1977 | Nuver |
| 4,014,115 | A | 3/1977 | Reichert |
| 4,020,572 | A | 5/1977 | Chiaramonte, Jr. |
| 4,128,861 | A | 12/1978 | Pelengaris |

(Continued)

FOREIGN PATENT DOCUMENTS

EP 0 121 026 B1 10/1984

(Continued)

OTHER PUBLICATIONS

Combined Search and Examination Report, dated Dec. 17, 2003, for corresponding United Kingdom application No. GB 0315369.9.

*Primary Examiner*—David Vu
(74) *Attorney, Agent, or Firm*—Brinks Hofer Gilson & Lione

(57) ABSTRACT

Illuminating devices may be added to footwear or other objects worn by persons. The illuminating devices are necessarily compact in nature, consisting primarily of flashing lights and a power-and-control circuit that controls and enables the flashing of the lights. The lights may be illuminated by differing voltage levels, so that lights will flash brighter or dimmer, in sequence, depending on whether the light receives a higher voltage or a lower voltage. The voltages may be achieved by using batteries in series. A unique flashing effect is achieved by the use of differing voltages in sequence on the same lamps or LEDs. A battery charger may also be included to restore battery life.

23 Claims, 11 Drawing Sheets

U.S. PATENT DOCUMENTS 4,130,951 A 12/1978 Powell
4,158,922 A 6/1979 Dana, III
4,231,079 A 10/1980 Heminover
4,253,253 A 3/1981 McCormick
4,298,917 A 11/1981 Ware
4,350,853 A 9/1982 Ganyard
4,367,515 A 1/1983 Beard
4,412,205 A 10/1983 Von Kemenczyk
4,459,645 A 7/1984 Glatter
4,588,387 A 5/1986 Swenson
4,701,146 A 10/1987 Swenson
4,800,469 A 1/1989 Leon
4,848,009 A 7/1989 Rodgers
4,870,325 A 9/1989 Kazar
4,897,947 A 2/1990 Kass-Pious
4,995,294 A 2/1991 Kashio et al.
5,016,144 A 5/1991 DiMaggio
5,027,035 A 6/1991 McGrail et al.
5,033,212 A 7/1991 Evanyk
5,052,131 A 10/1991 Rondini
5,099,192 A 3/1992 Thayer et al.
5,188,447 A 2/1993 Chiang et al.
5,285,586 A 2/1994 Goldston et al.
5,303,131 A 4/1994 Wu
5,303,485 A 4/1994 Goldston et al.
5,313,187 A 5/1994 Choi et al.
5,343,190 A 8/1994 Rodgers
5,353,441 A 10/1994 Lazorchak
5,357,697 A 10/1994 Lin
5,371,662 A 12/1994 Shen-Ko
5,381,615 A 1/1995 MacMillan
5,396,720 A 3/1995 Hwang et al.
5,400,232 A 3/1995 Wong
5,406,724 A 4/1995 Lin
5,408,764 A 4/1995 Wut
5,419,061 A 5/1995 Barrocas
5,422,628 A 6/1995 Rodgers
5,438,488 A 8/1995 Dion
5,438,493 A 8/1995 Tseng
5,455,749 A 10/1995 Ferber
5,456,032 A 10/1995 Matsumoto et al.
5,457,900 A 10/1995 Roy
5,461,188 A 10/1995 Drago et al.
5,463,537 A 10/1995 Trattner et al.
5,465,197 A 11/1995 Chien
5,477,437 A 12/1995 Lach
5,483,759 A 1/1996 Silverman
5,485,358 A 1/1996 Chien
5,490,338 A 2/1996 Hwang et al.
5,495,136 A 2/1996 Chiang et al.
5,495,682 A 3/1996 Chen
5,500,635 A 3/1996 Mott
5,508,899 A 4/1996 McCormick
5,516,149 A 5/1996 Moore
5,546,681 A 8/1996 Goldston et al.
5,550,721 A 8/1996 Rapisarda
5,566,479 A 10/1996 Gray et al.
5,577,828 A 11/1996 Nadel et al.
5,599,088 A 2/1997 Chien
5,604,999 A 2/1997 Barker
5,644,858 A 7/1997 Bemis
5,653,523 A 8/1997 Roberts
5,663,614 A 9/1997 Weng et al.
5,683,164 A 11/1997 Chien
5,730,520 A 3/1998 Hsu et al.
5,732,486 A 3/1998 Rapisarda
5,746,499 A 5/1998 Ratcliffe et al.
5,754,064 A 5/1998 Chien
5,758,946 A 6/1998 Chen
5,812,063 A 9/1998 Weng et al.
5,821,858 A 10/1998 Stone
5,839,814 A 11/1998 Roberts
5,844,377 A 12/1998 Anderson et al.
5,850,126 A * 12/1998 Kanbar ..... 315/200 A
5,855,382 A 1/1999 Reilly et al.
5,894,201 A 4/1999 Wong
5,903,103 A 5/1999 Garner
5,945,911 A 8/1999 Healy et al.
5,957,541 A 9/1999 Seigler
5,969,479 A 10/1999 Wong
6,012,822 A 1/2000 Robinson
6,094,141 A * 7/2000 Tsai ..... 340/573.1
6,145,999 A 11/2000 Van Derlande
6,164,794 A 12/2000 Rodgers
6,170,968 B1 1/2001 Caswell
RE37,220 E 6/2001 Rapisarda et al.
6,241,371 B1 6/2001 Dai
6,246,186 B1 6/2001 Nieberger
6,280,045 B1 8/2001 Anteby et al.
6,348,766 B1 2/2002 Ohishi et al.
6,354,712 B1 3/2002 Anteby
6,360,615 B1 3/2002 Smela
6,408,545 B1 6/2002 Song
6,525,487 B1 2/2003 Wei
6,619,812 B1 9/2003 Rapisarda
2003/0137852 A1 7/2003 Rapisarda

FOREIGN PATENT DOCUMENTS

EP 0 335 467 B1 6/1993
GB 2 144 000 A 2/1985
JP 54-133766 10/1979
JP 354133766 A 10/1979
JP 355080376 A 6/1980
JP 405021188 A 1/1993
WO WO 93/11681 6/1993

* cited by examiner

LOGIC

| PIN | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INITIAL | 0 | 1 | 0 | 0 | 1 | 1 | 0 | 1 | 1 | 0 | 1 | 0 | 0 | 1 |
| ROW1 | 0 | 1 | 0 | 1 | 0 | 0 | 0 | 0 | 0 | 1 | 0 | 1 | 0 | 1 |
| ROW2 | 0 | 1 | 0 | 0 | 1 | 1 | 0 | 1 | 1 | 0 | 1 | 0 | 0 | 1 |
| ROW3 | 0 | 0 | 1 | 0 | 1 | 1 | 0 | 0 | 0 | 1 | 0 | 0 | 1 | 1 |
| ROW4 | 0 | 1 | 0 | 0 | 1 | 1 | 0 | 1 | 1 | 0 | 1 | 0 | 0 | 1 |
| ROW5 | 0 | 0 | 1 | 0 | 1 | 1 | 0 | 0 | 0 | 1 | 0 | 0 | 1 | 1 |
| ROW6 | 0 | 1 | 0 | 0 | 1 | 1 | 0 | 1 | 1 | 0 | 1 | 0 | 0 | 1 |

DECADE COUNTER

| 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|
| 0 | 0 | 1 | 0 | 0 | 0 | 1 | 0 | 0 | 0 | 0 | 0 | 0 | 1 | 0 | 1 |
| 0 | 0 | 1 | 0 | 0 | 0 | 1 | 0 | 0 | 0 | 0 | 0 | 0 | 0 | 0 | 1 |
| 0 | 0 | 1 | 0 | 0 | 0 | 1 | 0 | 0 | 0 | 0 | 0 | 0 | 1 | 0 | 1 |
| 0 | 1 | 0 | 0 | 0 | 0 | 0 | 0 | 0 | 0 | 0 | 0 | 0 | 0 | 0 | 1 |
| 0 | 1 | 0 | 0 | 0 | 0 | 0 | 0 | 0 | 0 | 0 | 0 | 0 | 1 | 0 | 1 |
| 0 | 0 | 0 | 1 | 0 | 0 | 0 | 0 | 0 | 0 | 0 | 0 | 0 | 0 | 0 | 1 |
| 0 | 0 | 0 | 1 | 0 | 0 | 0 | 0 | 0 | 0 | 0 | 0 | 0 | 1 | 0 | 1 |

FIG. 8

FLASHING LIGHT SYSTEM WITH POWER SELECTION

FIELD OF THE INVENTION

This invention relates to flashing lights for shoes and other footwear. Embodiments of the invention may also be used in clothing and other items.

BACKGROUND OF THE INVENTION

Lighting systems have been incorporated into footwear, generating distinctive flashing of lights for persons wearing and seeing the footwear. These systems generally have an inertia switch, so that when a runner's heel strikes the pavement, the switch moves in one direction or another, triggering a response by at least one circuit that typically includes a power source and a means for powering and controlling the lights. The resulting light flashes are useful in identifying the runner, or at least the presence of a runner, because of the easy-to-see nature of the flashing lights. Thus, the systems may contribute to the fun of exercising while adding a safety feature as well. Prior art systems include those described in U.S. Pat. Nos. 5,894,201 and 5,969,479, which are hereby incorporated by reference in their entirety.

Flashing light systems may also be used in other shoes or footwear, for instance, for wearing at gatherings or parties. The flashing of lights adds a fun aspect to persons wearing the shoes and also for persons seeing the shoes. One deficiency is that prior art systems with batteries run down after a certain number of uses, and the lights no longer illuminate or flash. Thus, a user has only a limited amount of time or a limited number of uses before the lights will no longer illuminate.

Another deficiency is the limited voltage available to light lamps or LEDs used in flashing light systems. Some LEDs are designed to operate at a certain voltage, while others are designed to operate at higher voltages. In present systems, the lights are powered by a power supply at a single voltage. Thus, only one voltage is available for the LEDs. It would be desirable to be able to provide more than one voltage to lamps or LEDs in such a flashing light system. The present invention is directed at correcting this deficiency in the prior art.

SUMMARY

One embodiment is an illuminating system for a personal item. The system comprises a switch for controlling the illuminating system and a plurality of gates. There is a control circuit connected with the gates and at least two voltage sources connected with the gates. There is at least one lamp connected to the at least two voltage sources through at least two of the plurality of gates, wherein the control circuit and the plurality of gates are capable of applying at least two voltages sequentially to the at least one lamp.

Another embodiment is an illuminating system for footwear. The system comprises a power supply further comprising at least two batteries, and a control circuit, the control circuit receiving power from at least one battery. There is a primary gate connected electrically to the control circuit, and there is at least one switch for controlling the system, the switch electrically connected to the control circuit. There is also a plurality of secondary gates electrically connected to the control circuit and the power supply, and at least one LED connected to the power supply through at least two of the plurality of gates, wherein the control circuit and the plurality of gates are capable of applying at least two voltages sequentially to the at least one LED.

Another embodiment is a method for illuminating a personal item with a flashing light system. The method comprises connecting at least two voltage sources sequentially to at least one LED. The method also comprises illuminating the at least one LED by controlling at least two gates, and controlling a timing and at least one pattern of illumination of the LED.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

FIG. 8 depicts a truth table for logical operation of a flashing light circuit according to the present invention.

DETAILED DESCRIPTION OF THE PRESENTLY PREFERRED EMBODIMENTS

Figure 1:
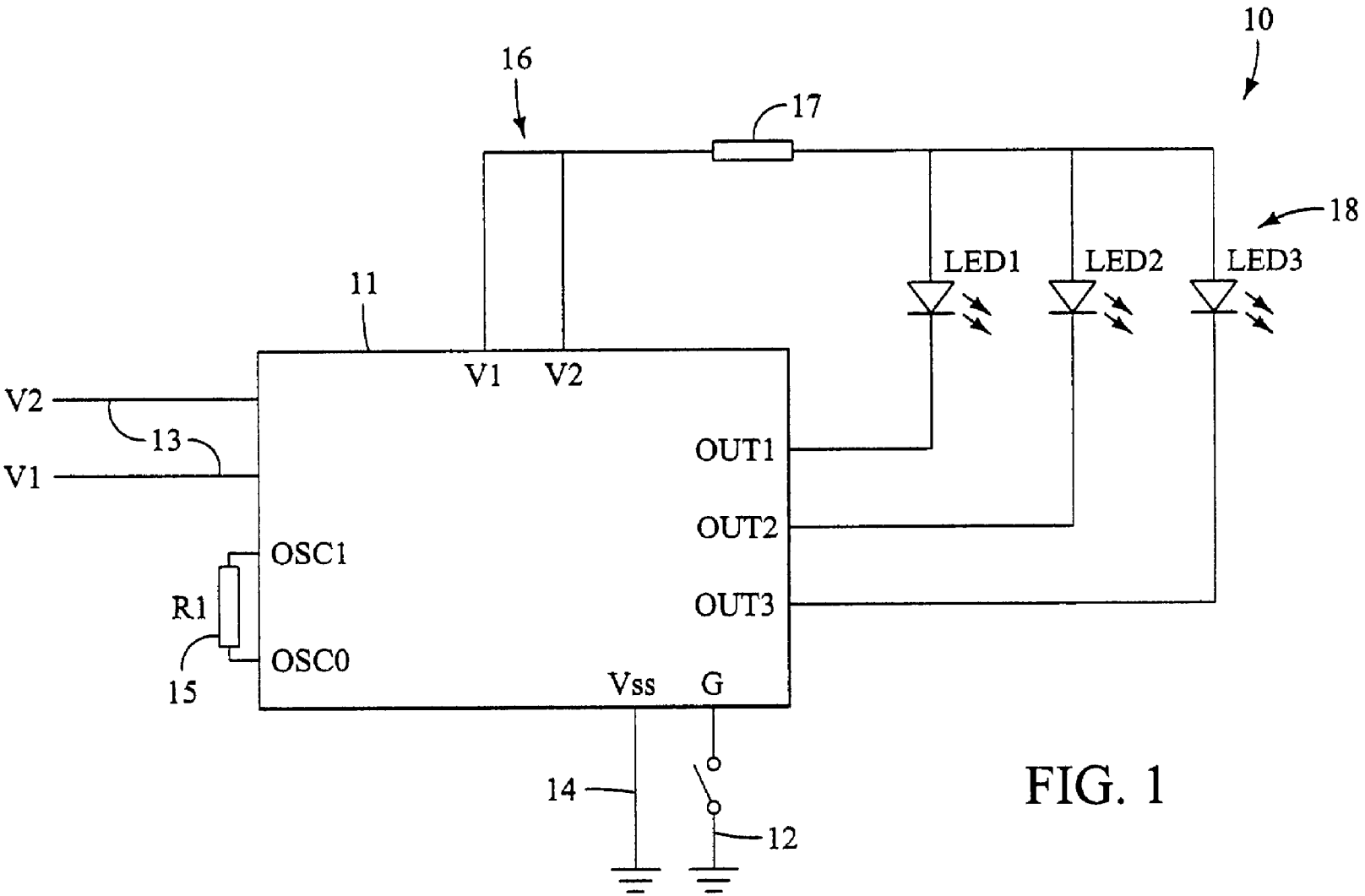
FIG. 1 is a block diagram of a first embodiment according to the present invention of a circuit for flashing LEDs.

Lighting or illumination systems for decoration or safety on clothing and personal articles must necessarily be compact and light-weight, so that the article to be illuminated can be easily adapted to receive and hold the illumination system. FIG. 1 represents a block diagram of such a system. An illumination system 10 comprises a controller 11, a switch 12, at least two voltage sources 13, a path to ground 14 and an oscillator resistor 15 for controlling the oscillation frequency. The voltages are connected to inputs of the controller 11 and to outputs 16 of the controller, V1 and V2. The outputs are intended to apply one voltage at a time through output resistor 17 to flashing lights 18, which may be LEDs or which may be other lamps. The switch may be an inertia switch, or may also be a touch switch or an on/off toggle switch, or any other suitable switch. In addition to a switch to begin flashing lights, there may be another switch to select one of several flashing sequences which may be stored in controller 11 or in other embodiments, may be stored in the memory of the controller or other component. Switch 12 notifies the controller to begin a sequence of flashing lights that is controlled by one or more patterns or routines that are programmed and stored in the controller. In this system, the voltages 13 may be any suitable voltages for the lamps or LEDs used, such as 1.5V to 6V or even higher voltages, from one or more batteries. The controller 11 routes one voltage at a time through current limiting resistor 17 to the LEDs 18. The circuit is completed when the controller closes circuits with pins OUT1, OUT2, or OUT3 in a predetermined pattern, such as a sequential flashing pattern, or other visually-interesting pattern. The LEDs may be any color that is commercially available, and should be rated in the range of about 1.5V to about 12V, the range of the power supplies or batteries available.

In this embodiment, outputs 16 may be either V1 or V2, which are different voltages, and thus different voltages are applied at different times to LEDs 18. When a greater voltage is applied, such as 4.5V, the LEDs will shine brightly. The voltages are applied through internal switching of the controller, which may be an integrated circuit or may be a custom-made or tailor-made circuit (application specific circuit) with internal gates for applying one voltage at a time from an input 13 to an output 16 using an internal gate for each voltage, such as V1 and V2. The controller completes the circuit and lights a lamp or an LED through OUT1, OUT2, or OUT3. When a lower voltage is applied such as 3V, the LEDs will shine less brightly. The LEDs may be any colors commercially available, such as red, green, blue, yellow, amber, white, purple, pink, orange, and so forth. The controller may be a custom-made oscillator-type integrated circuit, preferably in complementary MOS (CMOS) circuitry, made by a number of manufacturers, or the controller may be a different type of controller.

Figure 2:
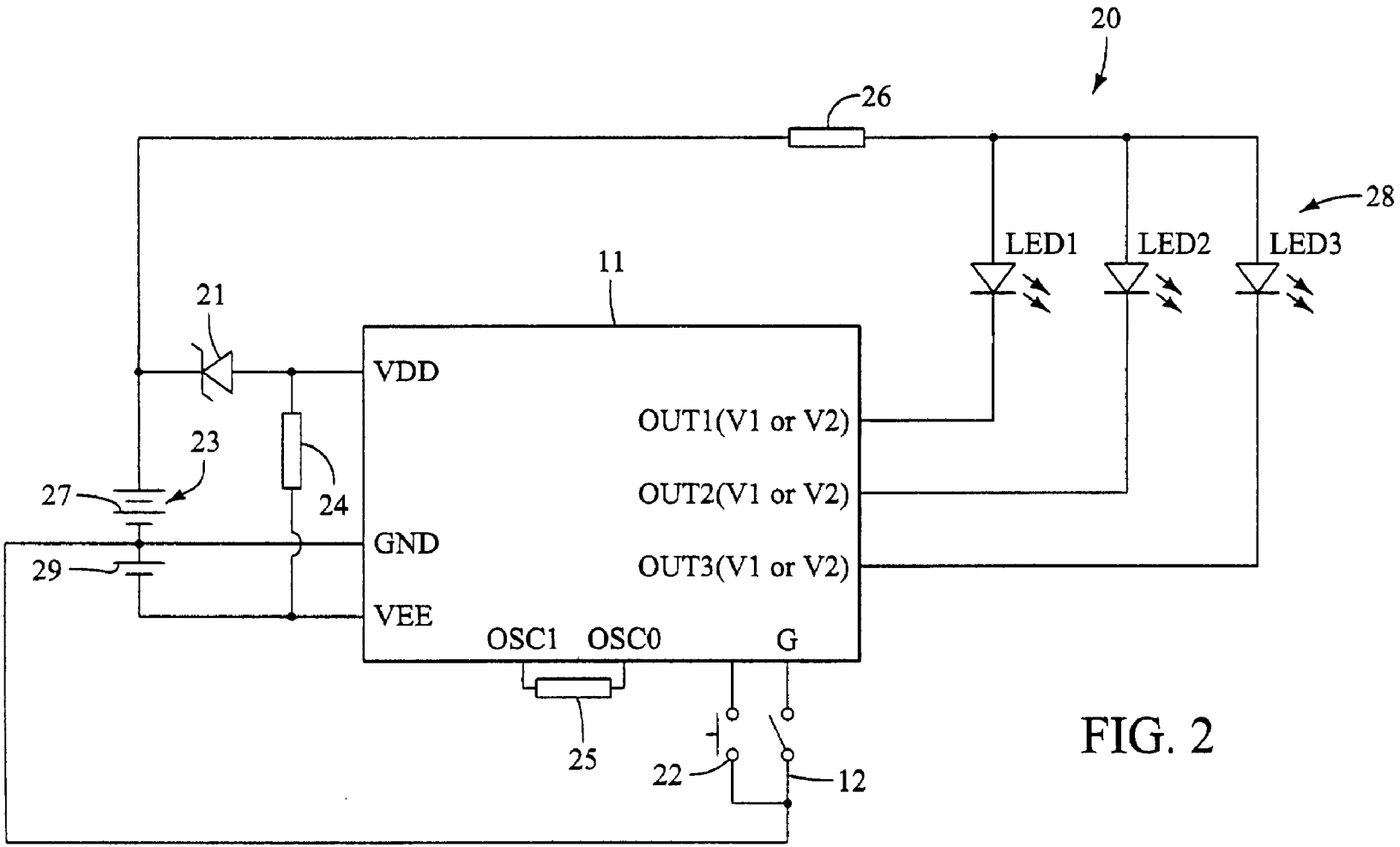
FIG. 2 is a block diagram of a second embodiment according to the present invention of a circuit for flashing LEDs.

Another embodiment of a flashing light circuit with a power selection feature is depicted in FIG. 2. In this embodiment, there may be one or more batteries 23 connected in series to the system. A flashing light system 20 includes a controller 11, which may be the same type oscillator controller as in FIG. 1, or may be a different controller. There is an optional on/off or toggle switch 12 and a second switch 22, such as an inertia switch or touch switch, connected to the integrated circuit or controller 11. The controller has a resistor 25 to control the speed of the circuit. A power source 23 is made of two batteries, 27, 29 connected in series, such as a 3V battery and a 1.5V battery, or two 3V batteries. Combinations may include CR2032, L1154, AAA, AA, C or D size batteries.

In this embodiment, 4.5V is routed to terminals Vdd and Vee within the controller. If the voltage across Vdd and Vee is greater than 4.5V, a Zener diode 21 and an optional resistor 24 may be added to protect controller 11. If batteries 27, 29 are respectively 3V and 1.5V, then 4.5 V is routed through current-limiting resistor 26 to LEDs 28. The LEDs are connected to pins of the controller, respectively OUT1, OUT2, and OUT3, where the controller can connect the LEDs to either 3V or 4.5 V by opening or closing gates within the controller. It should be understood that more than one power level may be used in designing and operating the circuit. It should also be understood that there may be more than three outputs and there may be a plurality of LEDs connected in parallel as shown, so that each LED receives the desired power level. Controllers suitable for this application may include custom-made or tailor-made circuits, such as application-specific circuits. Any controllers that will perform the indicated functions will work well for these purposes.

Figure 3:
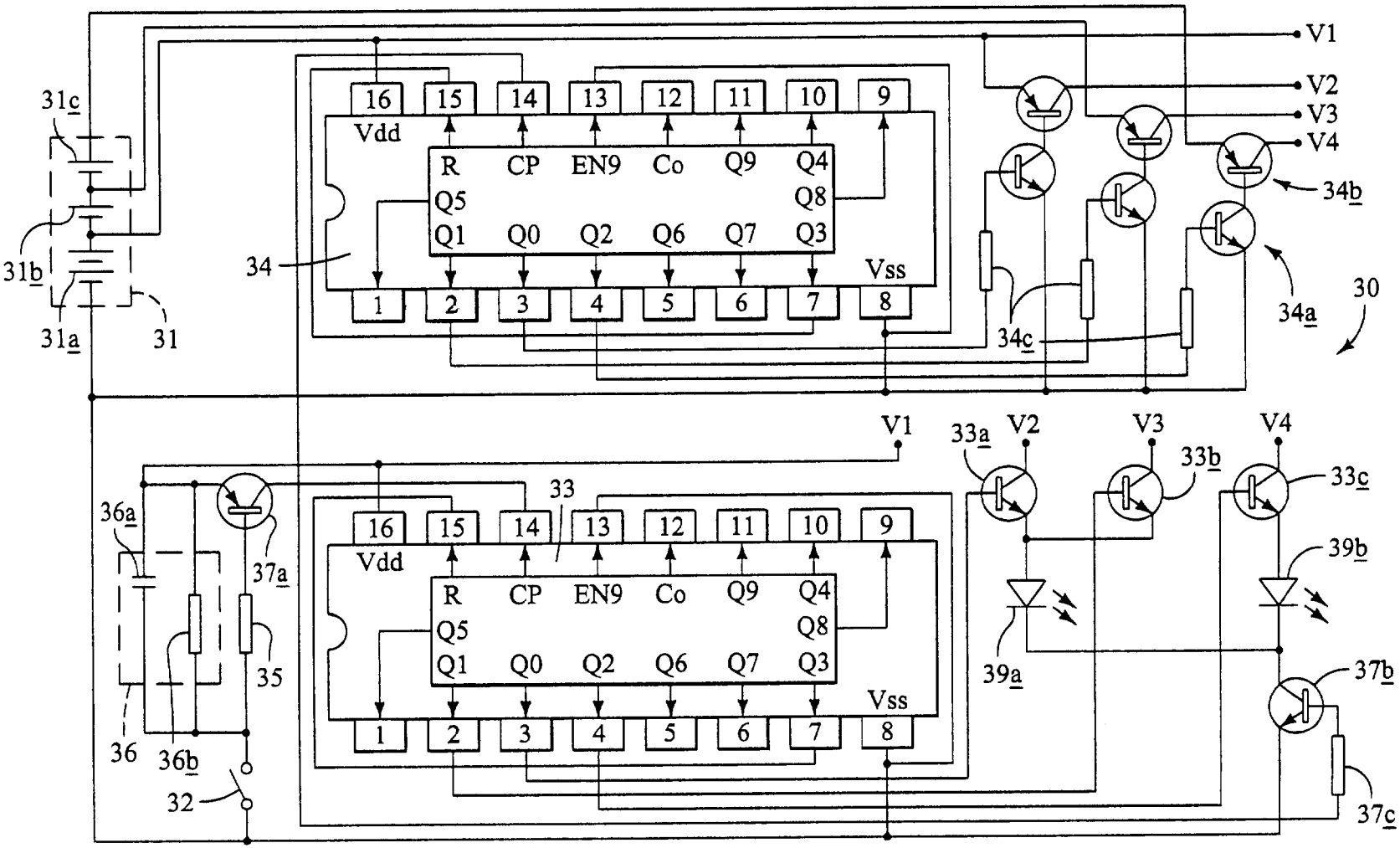
FIG. 3 depicts a block diagram of a third embodiment according to the present invention of a circuit for flashing LEDs.

Another embodiment of a system for power selection for flashing lights is depicted in FIG. 3. FIG. 3 is a block diagram of a system 30 for selecting power to LEDs 39*a* and 39*b* using a decade counter 33 and a second decade counter 34. In a preferred embodiment, the decade counters are CD4017 integrated circuits, available from several manufacturers. In FIG. 3, there is a power supply 31 comprising a 3V battery 31*a* connected in series with two 1.5V batteries 31*b* and 31*c*. As shown in FIG. 3, a first voltage, such as 3V, is routed to pin 16 of decade counter 34 for control power, and a second voltage, which may be 3V, is also routed to a voltage supply transistor 34*b* and to a pin labeled V1. In the illustrated embodiment, the first voltage and the second voltage are substantially 3V. Other voltages may be used in other embodiments.

The other voltages from power supply 31 are also routed to other voltage supply transistors 34*b*. The voltages available from the collectors of supply transistors 34*b* are thus 3V, 4.5V and 6V, less a small voltage drop across the transistors themselves. Thus, the voltages at pins V1, V2, V3 and V4, in one example of this embodiment, are 3V, 3V, 4.5V and 6V. Other voltages may be used, so long as at least V2 and V3 are different voltages.

The supply transistors 34*b* are controlled by control transistors 34*a*, connected to decade counter 34 through control resistors 34*c*, as shown. Power is routed from the upper V1–V4 pins connected to decade counter 34 to lower V1–V4 pins connected to the decade counter 33. Connections may be made by traces on a printed circuit board, or any other convenient method.

The system 30 is controlled by a switch 32, which may be an inertia switch, or may be a touch switch or a toggle switch, or other suitable switch. Switch 32 completes a circuit with primary gate or primary control transistor 37*a* through resistor 35. There is also a timing circuit 36 with a capacitor 36*a* and a resistor 36*b*. Decade counter 33 receives voltage V1 at pin 16 and is otherwise connected as shown in FIG. 3. The circuit also includes secondary control transistor or gate 37*b* and current-limiting resistor 37*c* connected to the cathodes of LEDs 39*a* and 39*b*. In this embodiment, the anode of LED 39*a* is connected to the emitters of two secondary control transistors 33*a* and 33*b*, one of which connects to voltage V2 and the other of which connects to voltage V3. Thus, if decade counter 33 turns on transistor 33*a*, connected to V2, LED 39*a* will receive about 3V. However, if decade counter 33 turns on transistor 33*b*, connected to V3, then LED 39*a* will receive 4.5 volts. If decade counter 33 turns on transistor 33*c*, LED 39*b* will receive voltage V4, in this example about 6V. In this embodiment, transistors 33*a*, 33*b* and 33*c* are turned on when sufficient base current and base-emitter voltage are provided to place the devices in a forward conducting state. While NPN bipolar transistors are shown in FIG. 3, it is to be understood that other types of transistors may be substituted.

When a user activates switch 32, either by touching a touch switch, or activating an inertia switch, for instance, by walking or running, the timing circuit 36 is activated by charging capacitor 36*a* and turning on primary gate or primary control transistor 37*a*. Decade counters 33 and 34 are activated, and a sequence of lights flashing will result for a period of time until capacitor 36*a* is discharged. Decade counter 34 will turn on transistor 37*b*, while decade counter 33 will turn on secondary control transistors or gates 33*a*, 33*b* and 33*c* to flash LEDs 39*a* and 39*b*. In this example, it will be understood that more LEDs may also be connected, some with more than one power level such as LED 39*a*, and some LEDs may be connected only to a single power level, as shown with LED 39*b*. The system may then cause the LEDs to flash in a sequence. The flashing sequence includes power levels, as LEDs may receive a greater voltage and illuminate more brightly, or a lesser voltage and illuminate less brightly.

Figure 4:
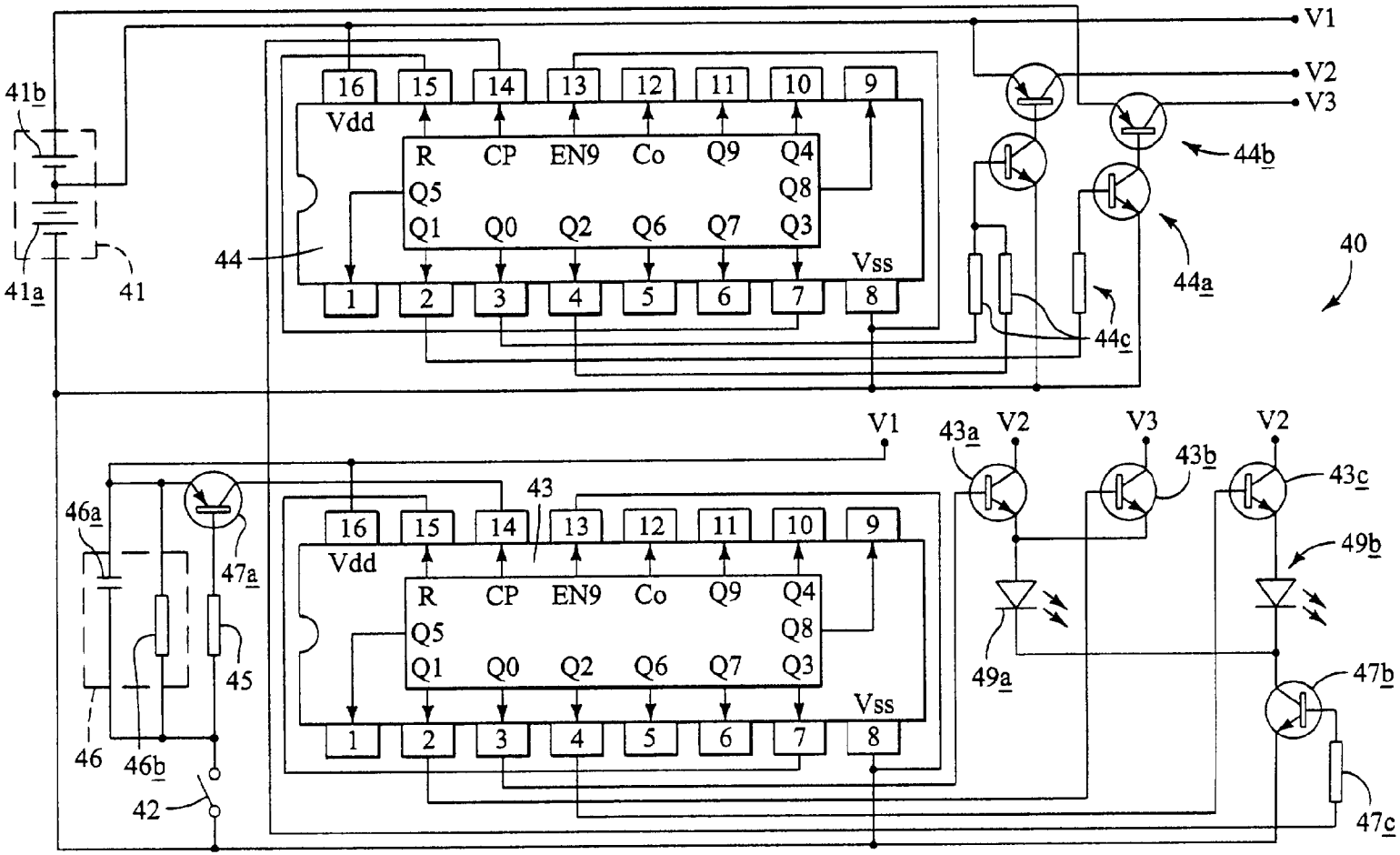
FIG. 4 is a block diagram of a fourth embodiment according to the present invention of a circuit for flashing LEDs.

Another embodiment of a flashing light system with power selection levels is the system 40 for flashing lights depicted in FIG. 4. In this system, there is a power supply 41 comprising two batteries 41*a* and 41*b*, which may be 3V and 1.5V batteries. Examples of a 3V battery include a CR2032 battery. Examples of a 1.5V battery include an AG13 battery (L1154). 3V from power supply 41 is routed to the decade counter 44, to pin 16 for power and control, and is also routed to the pin labeled V1. 3V is also routed to the emitter of one voltage supply transistor 44*b*, to the collector of that transistor as "V2." V2 will thus be 3V, less a small voltage drop across transistor 44*b*. 4.5V is routed from power supply 41 to a second voltage supply transistor 44*b*, producing voltage "V3" at the collector of that transistor. Other voltages may be used as desired.

The remainder of the circuit includes a decade counter 43, connected to decade counter 44 as shown, and also connected to secondary control transistors or secondary gates 43*a*, 43*b* and 43*c*, as well as LEDs 49*a* and 49*b*, and transistor 47*b* and resistor 47*c*. The system 40 is controlled by switch 42, which may be an inertia switch, a toggle switch, or a touch switch. There is also a primary control resistor 45 and primary gate or primary control transistor 47*a*. A timing circuit 46 includes a capacitor 46*a* and resistor 46*b*. This circuit operates in a manner similar to that described for the system of FIG. 3. In this system however, all LEDs, such as LEDs 49*a* and 49*b*, may be connected to voltage level V2, where V2 may be 3V or a little less than 3V. Some LEDs, such as 49*a*, may be connected to both V2 and V3 at different times. Thus, in this example, LED 49*a* may be connected to both V2, about 3V, and to V3, about 4.5 V, at different times, through secondary control transistors or secondary gates 43*a* and 43*b*. It will be understood that other voltage levels may be used, and that other components may be used to increase or decrease the voltages available to the LEDs. It will also be understood that a greater number of LEDs may be used in any of the circuits described herein. The flashing or illuminating of lamps or LEDs may also include power levels, as LEDs may receive a greater voltage and flash more brightly, or a lesser voltage and flash less brightly.

Figure 5:
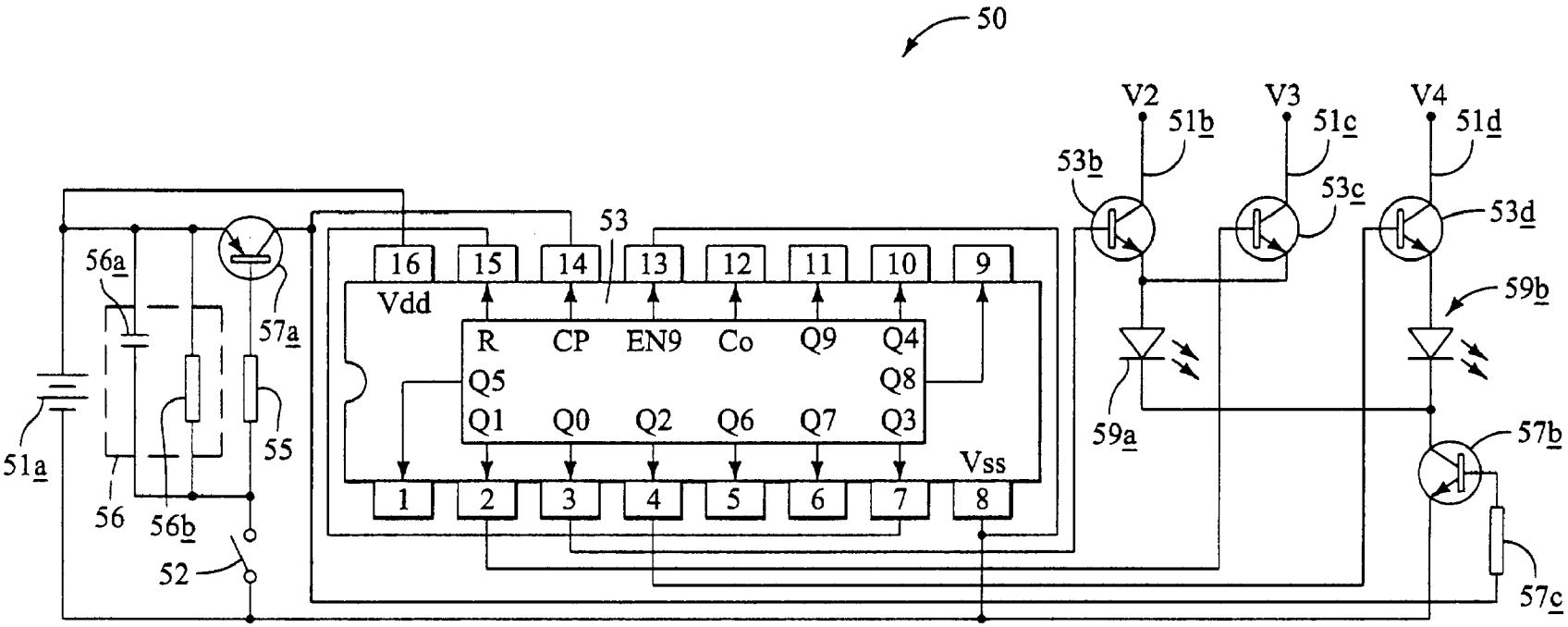
FIG. 5 is a block diagram of a fifth embodiment according to the present invention of a circuit for flashing LEDs.

Another embodiment of a flashing light system with the ability to select a power level is depicted in FIG. 5. This flashing light system 50 with power selection levels includes a control power supply 51*a* and additional voltage sources 51*b*, 51*c* and 51*d*. The voltage sources may be any convenient source of power useful for lighting LEDs, such as batteries. In this embodiment, voltage source 51*b* may be V2, voltage source 51*c* may be V3 and voltage source 51*d* may be V4. Examples of useful voltages may include 1.5V, 3V, 4.5V, 6V, 9V and 12V. Other voltages may also be used.

The circuit includes a switch 52, such as an inertia switch, and a timing circuit 56, which includes a capacitor 56*a* and a resistor 56*b*. Closing the switch activates primary gate or primary control transistor 57*a*, grounding the base of the transistor through resistor 55. This begins a flashing sequence with controller 53. In one embodiment, controller 53 may be a decade counter. The decade counter controls secondary control transistors 53*b*, 53*c*, 53*d* and control transistor 57*b* through resistor 57*c*. There may also be resistors connected between the gates of control transistors 53*b*, 53*c* 53*d* and controller 53. The flashing sequence turns on secondary control transistors or gates 53*b*, 53*c*, 53*d*, one at a time, to illuminate the lamps or LEDs. Thus, when transistor 53*b* is turned on, voltage V2 will be routed from voltage source 51*b* through transistor 53*b* to LED 59*a*, and then through control transistor 57*b* to complete the circuit. When transistor 53*c* is turned on, voltage V3 will be routed from voltage source 51*c* through transistor 53*c* to LED 59*a*, and then through control transistor 57*b*. If V2 is different from V3, then LED 59*a* will illuminate first with one power level or brightness, and later with a second power level or brightness. Thus, the flashing lights are designed to illuminate at different brightnesses in response to different power levels. This results in a more varied and interesting flashing pattern. In this embodiment, LED 59*b* receives only V4 power through secondary control transistor 53*d*.

Figure 6:
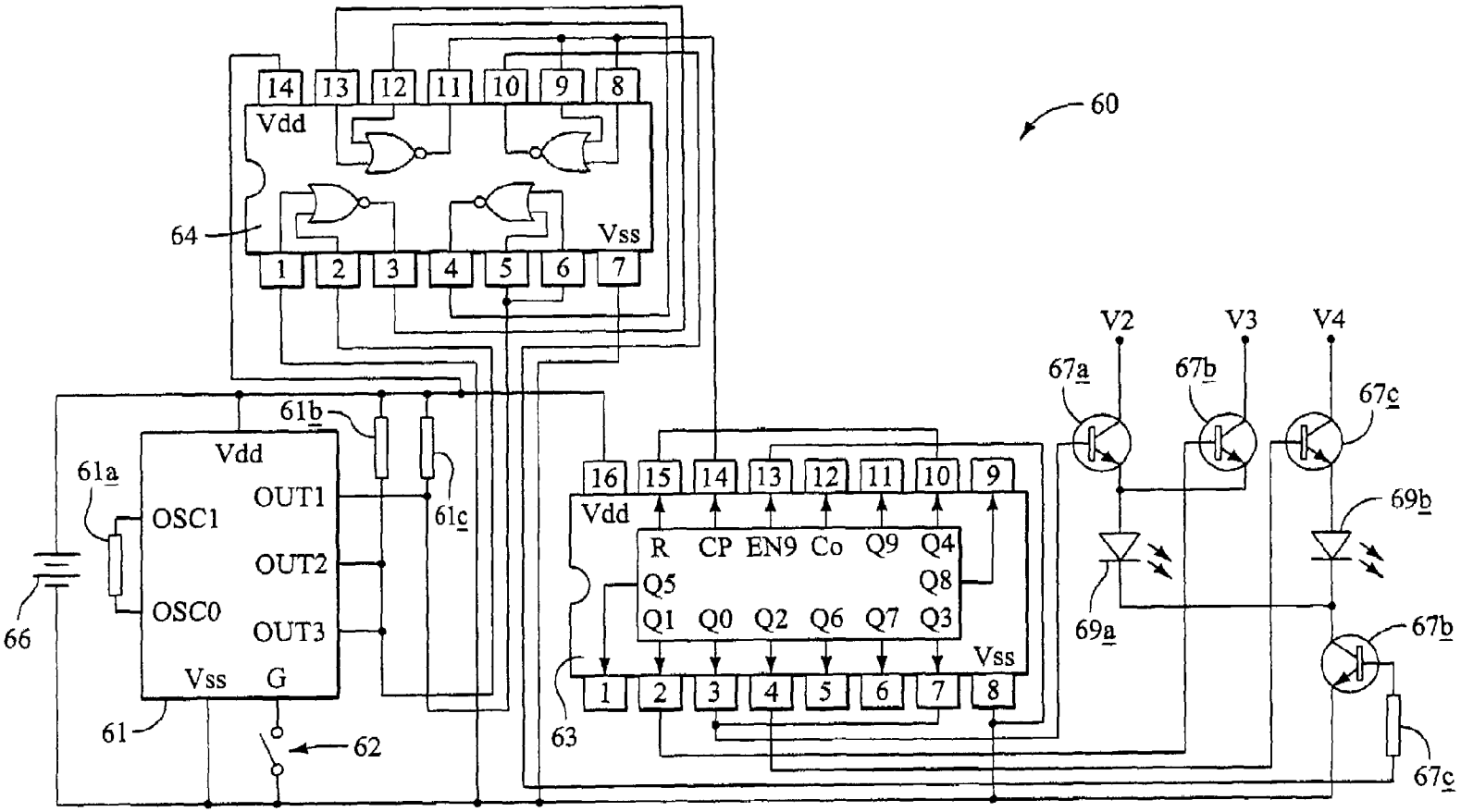
FIG. 6 is a block diagram of a sixth embodiment according to the present invention of a circuit for flashing LEDs.

FIG. 6 depicts another embodiment of a flashing light system 60 with power selection levels. This system 60 includes a controller 61, a decade counter 63 and a quad NOR gate 64. There is a control switch 62, which may be an inertia switch, and a control power supply 66. Power supply 66 is preferably a 3V battery. The system includes three voltage levels, V2, V3, V4 for applying power to LEDs 69*a* and 69*b*. Voltage levels V2, V3, V4 may be supplied by batteries in series connected to secondary control transistors 67*a*, 67*b*, 67*c*. These voltages may be the same or may be different, so long as at least two of V2, V3 and V4 are different voltages. The controller 61 may be an 8533 or M1320 or M1389 RC oscillator integrated circuit with a control resistor 61*a*. M1320 and M1389 RC integrated circuits are made by MOSdesign Semiconductor Corp., Taipei, Taiwan. Controller 61 may have an internal timer to limit a time for flashing LEDs 69*a*, 69*b*.

The outputs of controller 61 may be connected through resistors 61*b*, 61*c* as shown to a quad NOR gate 64. Quad NOR gate 64 controls the flashing lights through decade counter 63 and control transistor 67*b* through resistor 67*c*. One or more sequences of flashing lights may be stored flashing light system 60. In this embodiment, voltage V2 or voltage V3 may be routed to LED 69*a* through secondary control transistors or gates 67*a* or 67*b*. Voltage V4 is routed to LED 69*b* through secondary control transistor or gate 67*c*. It will be understood that a greater number of LEDs may be used in any of the circuits described herein. Using flashing patterns stored in the system 60, the system may then cause the LEDs to flash in the footwear or other item. The flashing sequence may also include power levels, as LEDs may receive a greater voltage and flash more brightly, or a lesser voltage and flash less brightly.

A "truth table" may be constructed for the circuit shown in FIG. 6. The "truth table is depicted in FIG. 8. The truth table is meant to depict the outputs of the logic and decade counter circuits used in FIG. 6, designated as numerals 64 and 63 respectively. The columns in FIG. 8 depict the pins in the circuits, and successive rows in the truth table express timing sequences in which a voltage or an output is present or is not present on the indicated pin. In the logic circuit, pin 14 is Vdd and is thus always "on" or "1," indicating that there is a voltage to the circuit, while pin 1 is connected to ground is thus always "off" or "0." In the decade counter, pin 16 is Vdd and is always high or "1," while pin 8 is ground and is always low or "0." Power to the LEDs is represented by the pins 2, 3, and 4 of the decade counter and by pin 10 of the logic. When logic pin 10 is high or "1" and one of pins 2, 3 and 4 is high or "1," the LED connected to output 2, 3, or 4 will flash or light up.

In the truth table of FIG. 8, LEDs will thus flash during the time periods corresponding to rows 1, 3, and 5. The LEDs will flash in sequence. Other sequences may be used. In this example, during the time period corresponding to row 1, pin 3 of the decade counter will be high as will pin 10 of the logic circuit. Thus, transistor 67*a* will conduct and LED 69*a* will be illuminated in response to voltage V2. No power will be applied to any LED during the time period corresponding to row 2, since pin 10 of the logic circuit is low or "0." During the time period corresponding to row 3, pin 10 of the logic circuit is now high or "1," and pin 2 of the decade counter is high or "1." Therefore, transistor 67*b* will conduct, connecting voltage V3 to LED 69*a*, and LED 69*a* will illuminate. During the period corresponding to row 4, pin 10 of the logic circuit goes low or "0," and no LEDs illuminate. During the period corresponding to row 5, pin 10 of the logic circuit goes high or "1," while pin 4 of the decade counter also goes high or "1." Therefore, transistor 67*c* conducts, connecting voltage V4 to LED 69*b*, which then illuminates. The sequence then continues for as long as it has been programmed, or until a timing capacitor in the circuit discharges.

Figure 7:
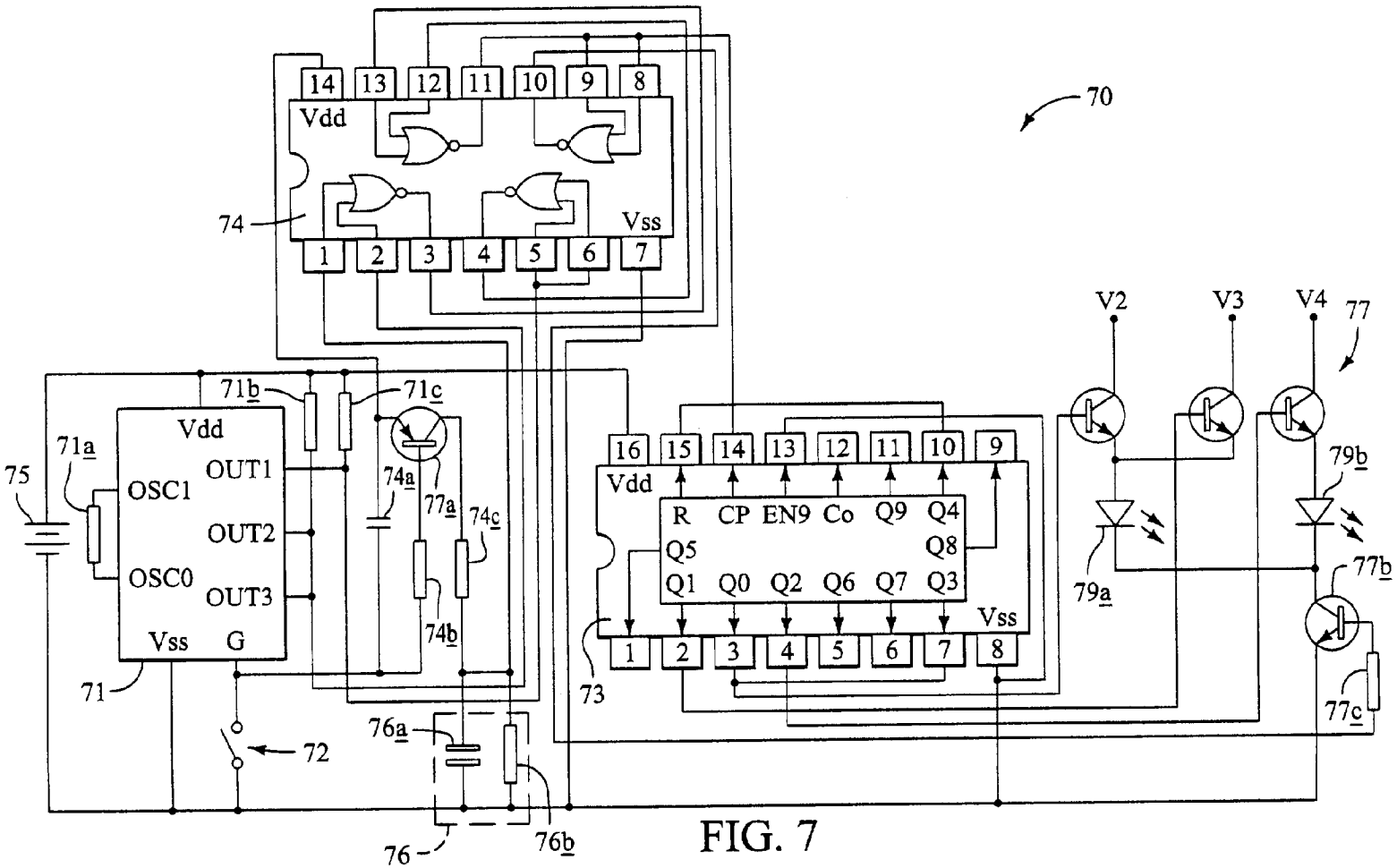
FIG. 7 is a block diagram of a seventh embodiment according to the present invention of a circuit for flashing LEDs.

Another embodiment of a flashing light system with power selection levels is system 70, depicted in FIG. 7. The system 70 of FIG. 7 is preferably manufactured in a complementary metal-oxide semiconductor (CMOS) implementation on a single integrated circuit, such as an M1320 or M1389 integrated circuit made by MOSdesign Semiconductor Corp., Taipei, Taiwan, in order to save cost and space. A toggle switch or other on/off switch also helps to preserve battery life. It is understood that most of the components of the system will be included in the integrated circuit, with the exception of the LEDs, the power supplies or batteries, and one or more switches. In the embodiment of FIG. 7, there is an RC oscillator integrated circuit 71, with circuits equivalent to an 8533, M1320 or M1389 RC oscillator integrated circuit. There is a logic circuit 74, with circuits equivalent to a CD4001 quad NOR gate, and a decade counter 73, with circuits equivalent to a CD4017 decade counter/divider. These circuits are connected as shown in FIG. 7. Operation of the circuit is controlled by a switch 72 and a timing circuit 76 that includes a capacitor 76*a* and a resistor 76*b* as shown.

The integrated circuit 71 may include a control resistor 71*a* and output resistors 71*b*, 71*c* connecting oscillator 71 to quad NOR gate 74. The circuit includes primary gate or primary control transistor 77*a*, capacitor 74*a*, gate resistor 74*b* and primary control resistor 74*c*. Decade counter/divider 73 stores one or more flashing sequences for LEDs 79*a*, 79*b*, and connects the LEDs to voltages V2, V3, V4 through secondary control transistors or secondary gates 77. Quad NOR gate 74 controls primary control transistor or primary gate 77*b* through control resistor 77*c* to complete the circuit for the LEDs. Voltages V2, V3 and V4 may be the same or may be different, so long as at least two are different voltages. The voltages may be supplied by a batteries in series connected to points V2, V3, and V4. Power supply 75 is preferably a 3V battery, a 4.5V battery, or a 6V battery.

Figure 9:
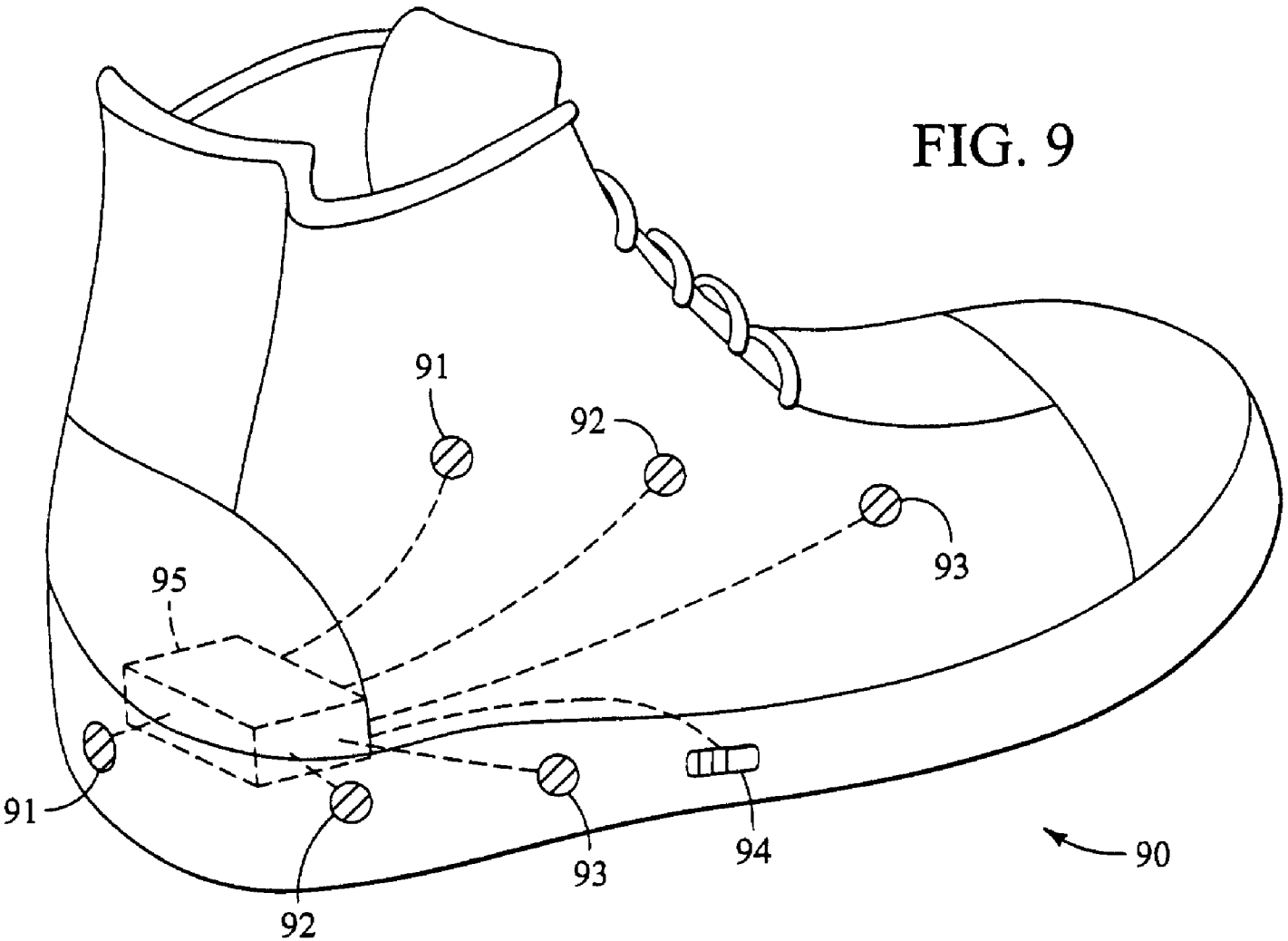
FIG. 9 depicts a shoe with a flashing light system according to the present invention.

FIG. 9 depicts a shoe 90 that incorporates the flashing light system with power selection levels. The shoe includes a flashing light system controller 95 and may include a toggle or on/off switch 94 placed on the outside of the shoe so that the wearer may turn the system on or off. The system includes a plurality of lamps or LEDs 91, 92, 93 placed for visibility on an outside surface of the shoe for flashing by the controller 95. In this embodiment, LEDs 91 may be green, LEDs 92 may be blue, and LEDs 93 may be red. The system and controller 95 may include two batteries as described above for delivery at least two voltage levels in succession to the LEDs. The system may also include an inertia switch for activation by running or other motion by the wearer of the shoe.

Figure 11:
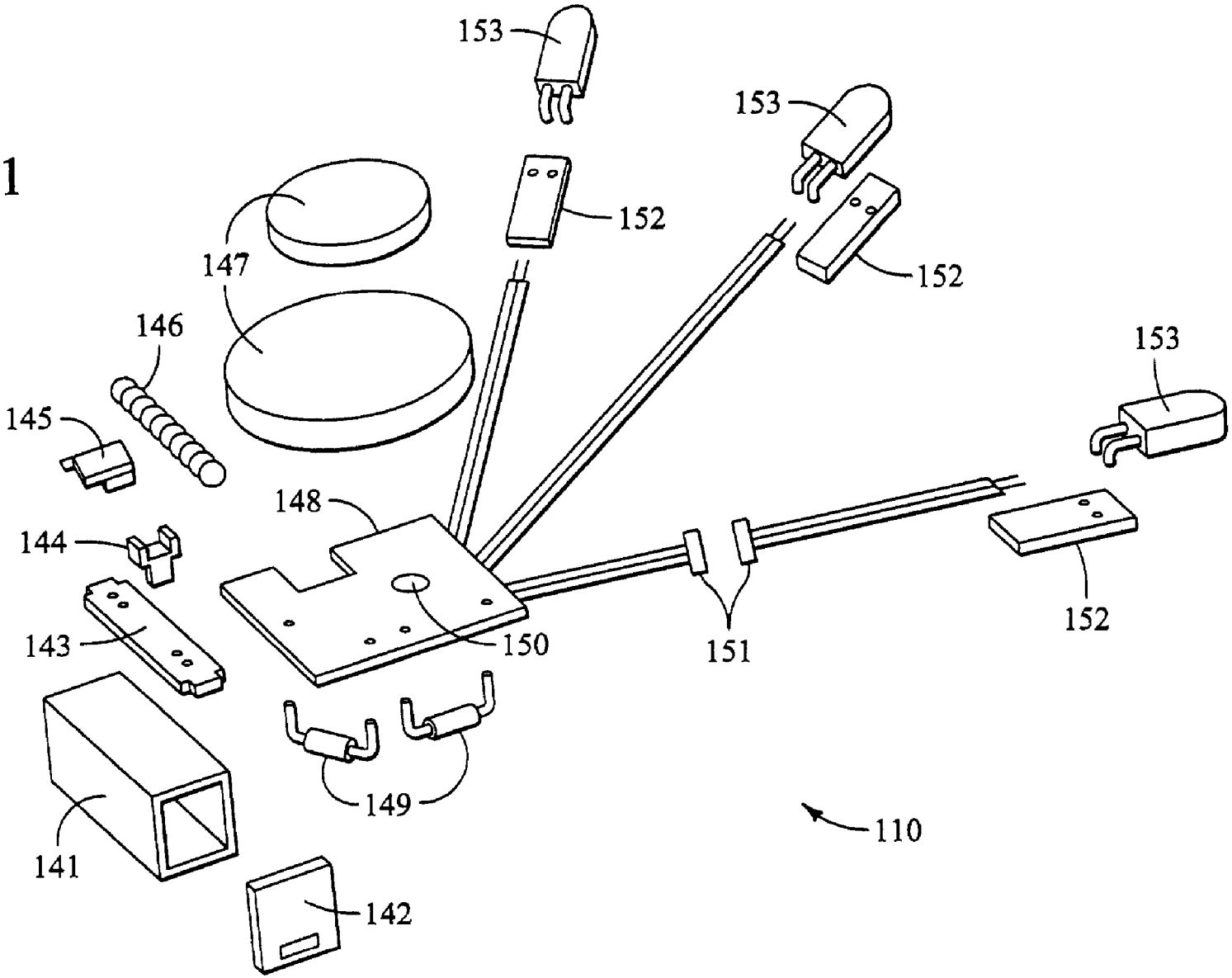
FIG. 11 depicts components of one embodiment of a flashing light system suitable for a shoe.

FIG. 11 depicts the components of one embodiment of a flashing light system 110 for use in footwear. The components include a motion or inertia switch with a spring housing 141 and housing cover 142, a small spring printed circuit board (PCB) 143 inside the housing, a spring stand 144, a spring contact 145, and a spring 146. One end of spring 146 is usually soldered or otherwise attached to spring stand 144. The system also includes at least two batteries 147 and a printed circuit board 148. A controller 150 and resistors 149 are mounted on the printed circuit board (PCB) 148. Lamps or LEDs 153 are connected to the controller and power source via wires and connectors 151 or by wires directly. The lamps or LEDs and one of the wire ends may also be mounted with mounting connectors or PCBs 152. Motion of the shoe bounces spring 146 to momentarily contact spring contact 145 and completes the circuit, bring power to the controller and beginning a sequence of flashing lights. LEDs may include any size and shape, and preferably include 5 mm round shapes, 5 mm flat shapes, and 3 mm round shapes.

Figure 10:
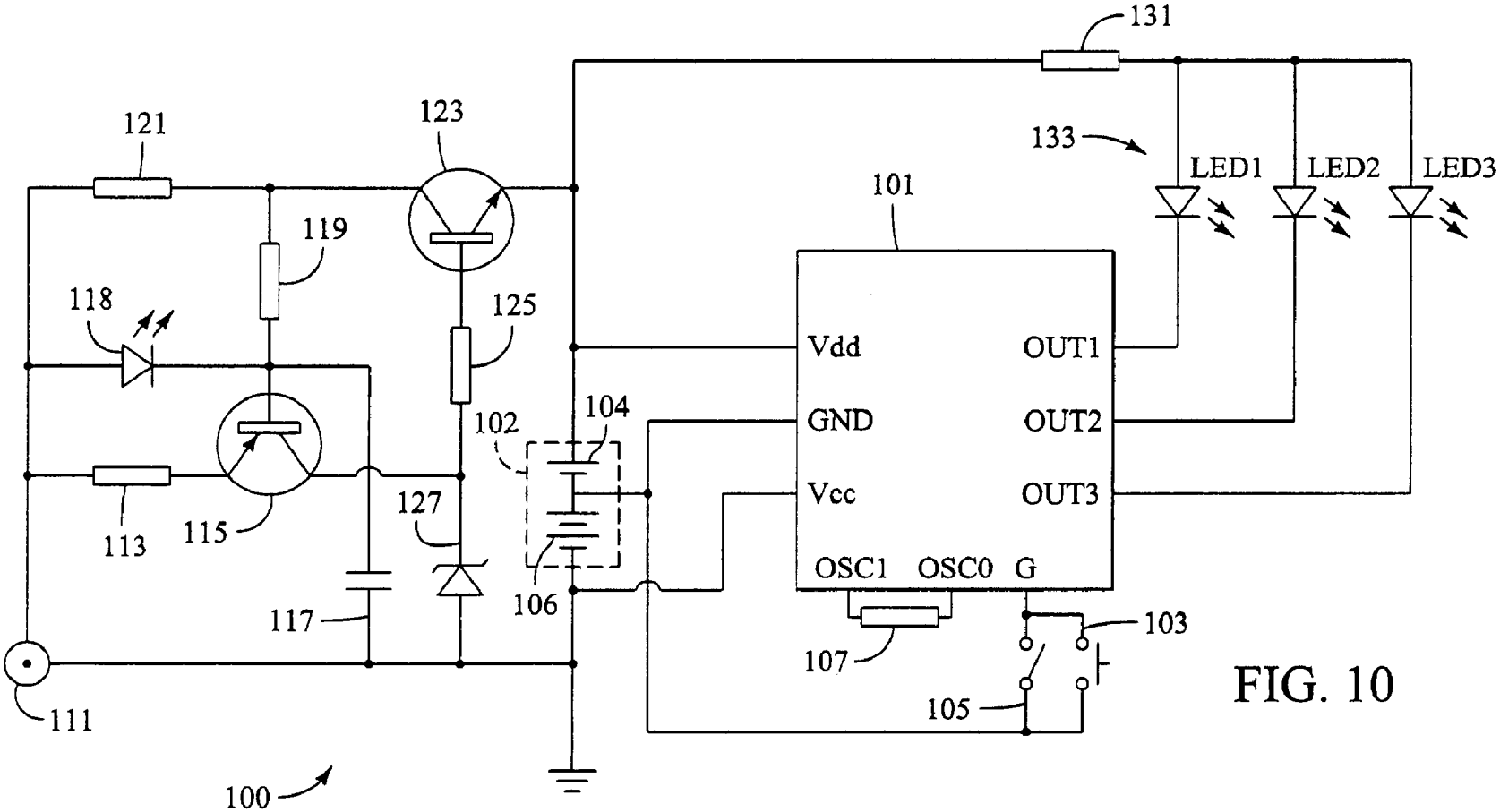
FIG. 10 depicts another embodiment of a flashing light system incorporating a battery charger.

Another embodiment of the invention includes a battery charging circuit along with the flashing light system. FIG. 10 depicts such an embodiment. There is a controller 101, a power supply 102 with at least two batteries 104, 106, and switches 103, 105. Switch 103 may be an inertia switch and optional switch 105 may be a toggle switch or other convenient and useful switch. The controller routes power through resistor 131 to LEDs 133. The circuit of 101 may route LEDs 133 to one of at least two different voltages within controller 101, such as 3V and 4.5V through pins OUT1, OUT2, and OUT3, for LED1, LED2 and LED3 respectively.

The battery-charging portion of the circuit includes an input jack 111 for inputting suitable recharging power. The recharging voltage should be the sum of batteries 104, 106 within the power supply 102. Thus, if batteries 104, 106 are each 4.5 V, then 9V input DC power should be used to recharge the batteries. If the battery has run down, and the base-emitter voltage difference across transistor 123 is greater than about 0.7V when DC power is applied to jack 111, transistor 123 will conduct and will charge batteries 104, 106. The circuit includes a capacitor 117 which charges up, turning on transistor 115 and then transistor 123. The batteries charge up, conducting current through LED 118 so that a user may monitor the charging. The process is regulated by resistors 113, 119, 121, and 125, and a Zener diode 127, which controls the desired voltage across the power supply during re-charging. Other recharging circuits may be used instead.

It will be understood that embodiments covered by claims below will include those with one of the above circuits, as well as circuits in which most of the components are integrated into a single integrated circuit, so that economy of operation may be achieved, while at the same time providing for a variety of pleasing applications. Components not included in the integrated circuit will include larger items, such as batteries, switches, the LEDs themselves, and the like.

Any of the several improvements may be used in combination with other features, whether or not explicitly described as such. Other embodiments are possible within the scope of this invention and will be apparent to those of ordinary skill in the art. For instance, two-color LEDs connected with one anode and two cathodes, or in which the anode of one is the cathode of the other may also be used with appropriate connections. Therefore, the invention is not limited to the specific details, representative embodiments, and illustrated examples in this description. Accordingly, the invention is not to be restricted except in light as necessitated by the accompanying claims and their equivalents.

What is claimed is:

1. An illuminating system for a personal item, the system comprising:

a switch for controlling the illuminating system;

a plurality of gates;

a control circuit connected with the gates;

at least two voltage sources connected with the gates; and at least one lamp connected to the at least two voltage sources through at least two of the plurality of gates, wherein the control circuit and the plurality of gates are capable of applying at least two voltages sequentially to the at least one lamp.

2. The system of claim 1, further comprising at least one lamp connected to a single voltage source through at least one of the plurality of gates.

3. The system of claim 1 wherein the personal item is a shoe.

4. The system of claim 1 wherein the control circuit comprises at least one of an integrated circuit, a custom-made integrated circuit, an oscillator circuit, and a decade counter/divider.

5. The system of claim 1, wherein the at least two voltage levels are selected from the group consisting of 1.5V, 3V, 4.5V, 6V, 9V and 12V.

6. The system of claim 1, wherein the at least one lamp comprises an LED, and the LED flashes at least one color selected from the group consisting of red, green, yellow, pink, orange, purple, amber, white and blue.

7. The system of claim 1, wherein the switch comprises at least one of an inertia switch, a touch switch, and a toggle switch.

8. The system of claim 1, further comprising a primary gate connected with the switch.

9. The system of claim 8, wherein the primary gate comprises a transistor and further comprising a capacitor connected through a resistor to a base of the transistor and a terminal selected from the group consisting of a collector and an emitter of the transistor.

10. The system of claim 1, wherein the at least two voltage sources comprise at least two batteries connected in series and wherein the plurality of gates is capable of applying at least two voltages sequentially to the at least one lamp.

11. The system of claim 1, further comprising a battery charging circuit connected to at least one of the voltage sources.

12. An illuminating system for footwear, the system comprising:

a power supply further comprising at least two batteries;

a control circuit receiving power from at least one battery;

a primary gate connected electrically to the control circuit;

at least one switch for controlling the primary gate, the switch electrically connected to the control circuit;

a plurality of secondary gates electrically connected to the control circuit and the power supply; and at least one LED connected to the power supply through at least two of the plurality of gates, wherein the control circuit and the plurality of gates are capable of applying at least two voltages sequentially to the at least one LED.

13. The system of claim 12, wherein the switch is selected from the group consisting of an inertial switch, a touch switch and a toggle switch.

14. The system of claim 12, wherein the primary gate comprises a transistor and further comprising a capacitor connected through a resistor to a base of the transistor and a terminal selected from the group consisting of a collector and an emitter of the transistor.

15. The system of claim 12, further comprising at least one additional LED connected through at least one of the plurality of gates to a single voltage source.

16. The system of claim 12 wherein the at least one switch comprises a first switch for beginning a flashing sequence and a second switch for at least one of turning the system on and off and selecting a flashing sequence.

17. The system of claim 12, wherein the at least two voltage levels are selected from the group consisting of 1.5V, 3V, 4.5V, 6V, 9V and 12V.

18. The system of claim 12, further comprising a battery charging circuit connected to the power supply.

19. The system of claim 12, further comprising at least one connector, wherein the at least one LED is connected to the power supply through the at least one connector.

20. A method for illuminating a personal item with a flashing light system, the method comprising:

connecting at least two voltage sources sequentially to at least one LED;

illuminating the at least one LED by controlling at least two gates; and controlling a timing and at least one pattern of illumination of the LED.

21. The method of claim 20, further comprising beginning the method for illuminating by closing a switch.

22. The method of claim 20, further comprising providing at least two voltage sources by routing power through transistor switches to the at least two gates.

23. The method of claim 20, further comprising selecting a pattern of illuminating with a selector switch.

* * * * *